United States Patent [19]

Franke et al.

[11] 4,207,151

[45] Jun. 10, 1980

[54] ELECTROHYDRODIMERIZATION PROCESS IMPROVEMENT AND IMPROVED ELECTROLYTE RECOVERY PROCESS

[75] Inventors: Fritz R. Franke; Leonard L. Hovey; George H. Mock; Andrew M. Patterson, Jr., all of Pensacola, Fla.

[73] Assignee: Monsanto Company, St. Louis, Mo.

[21] Appl. No.: 693,062

[22] Filed: Jun. 4, 1976

[51] Int. Cl.[2] ..... C26B 3/00

[52] U.S. Cl. ..... 204/73 R; 204/73 A

[58] Field of Search ..... 204/73 R, 73 A

[56] References Cited

U.S. PATENT DOCUMENTS

| | | | |
|---|---|---|---|
| 3,267,131 | 8/1966 | Campbell et al. | 204/73 A X |
| 3,493,597 | 2/1970 | Campbell et al. | 204/73 A X |
| 3,898,140 | 8/1975 | Lester et al. | 204/73 A |
| 3,966,566 | 6/1976 | Lester et al. | 204/73 R |

*Primary Examiner*—F. C. Edmundson

*Attorney, Agent, or Firm*—Thomas Y. Awalt, Jr.

[57] ABSTRACT

An improvement in an electrolytic hydrodimerization process for hydrodimerizing an olefinic compound such as acrylonitrile to form a dimerized product such as adiponitrile in which an aqueous electrolyte solution comprised of the olefinic compound, a directive salt (providing quaternary ammonium cations) and a conductive salt is electrolyzed in a reaction cell, the aqueous solution is purged from the reaction cell, and subjected to a series of steps involving the recovery of the product, the directive salt and the conductive salt, the recovered salts being used to reconstitute the aqueous solution, the improvement being a functionally coordinated evaporation step which permits a higher rate and more efficient recovery of product and salts, a higher purge rate and a substantially higher yield of the dimerized product. The invention also constitutes an improved electrolyte recovery process.

15 Claims, 1 Drawing Figure

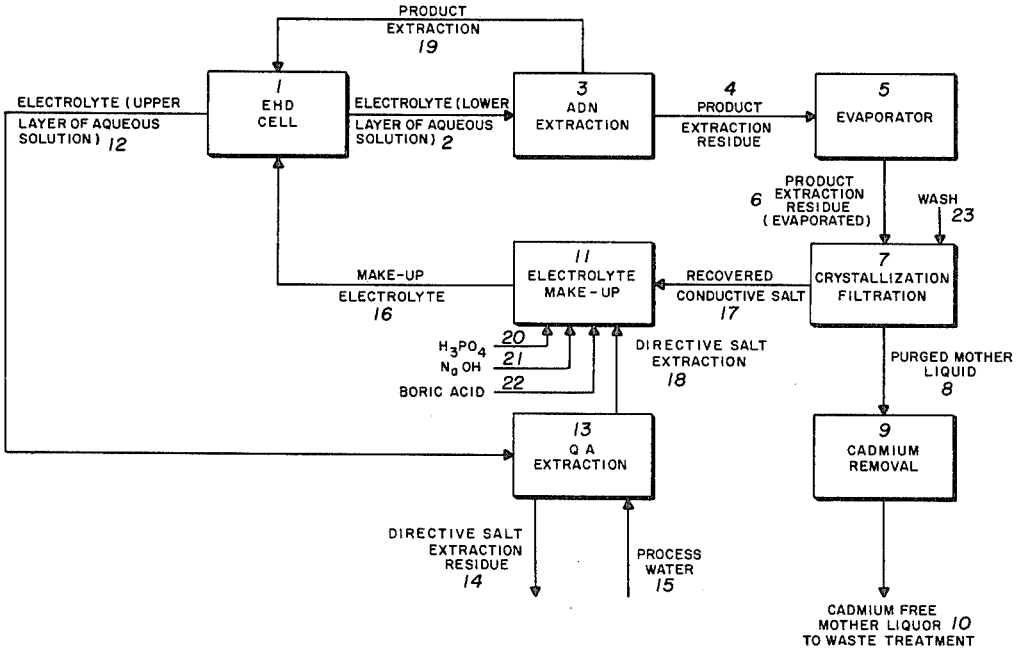

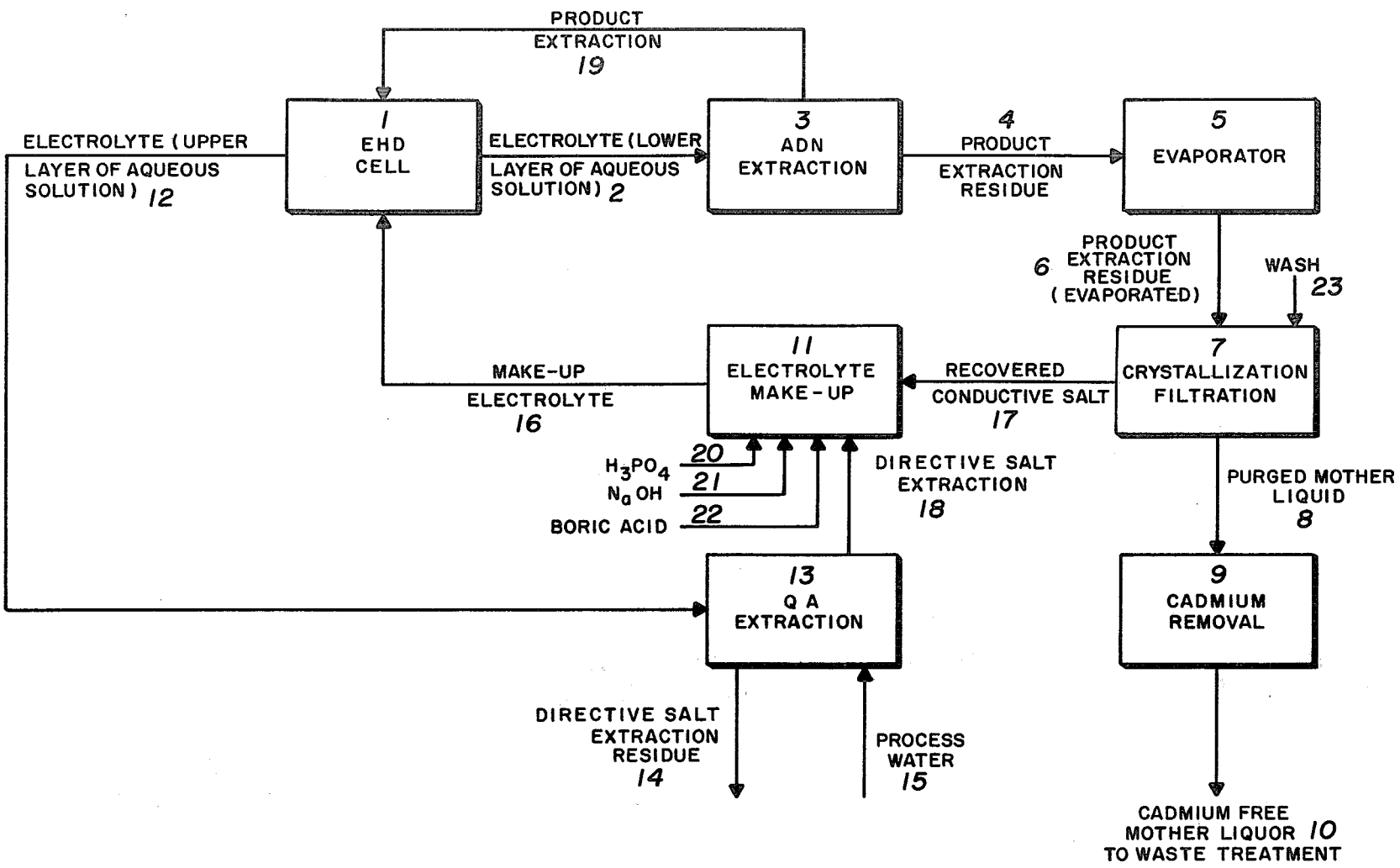
1 EHD CELL
3 ADN EXTRACTION
5 EVAPORATOR
7 CRYSTALLIZATION FILTRATION
9 CADMIUM REMOVAL
11 ELECTROLYTE MAKE-UP
13 Q A EXTRACTION
ELECTROLYTE (UPPER LAYER OF AQUEOUS SOLUTION) 12
ELECTROLYTE (LOWER LAYER OF AQUEOUS SOLUTION) 2
PRODUCT EXTRACTION 19
4 PRODUCT EXTRACTION RESIDUE
PRODUCT EXTRACTION RESIDUE (EVAPORATED) 6
WASH 23
PURGED MOTHER LIQUID 8
CADMIUM FREE MOTHER LIQUOR TO WASTE TREATMENT 10
RECOVERED CONDUCTIVE SALT 17
DIRECTIVE SALT EXTRACTION 18
MAKE-UP ELECTROLYTE 16
$H_3PO_4$ 20
NaOH 21
BORIC ACID 22
PROCESS WATER 15
DIRECTIVE SALT EXTRACTION RESIDUE 14

ELECTROHYDRODIMERIZATION PROCESS IMPROVEMENT AND IMPROVED ELECTROLYTE RECOVERY PROCESS

BACKGROUND OF THE INVENTION a. Scope of the invention

This invention relates to the separation and recovery of various components of the cathode effluent or "purge" from the electrolytic manufacture of a dimerized product such as adiponitrile from an olefinic compound such as acrylonitrile. More particularly, it relates to a process for the separation and recovery of the olefinic compound, the dimerized product, conductive salt and quaternary ammonium (directive) salt contained in the cathode effluent from the electrohydrodimerization of an olefinic compound, as recovery of these constituents relate to the purge rate of the cell (the speed with which the aqueous solution is evacuated from the cell and the corresponding speed with which the aqueous solution in the cell in replenished) and maintenance of process water balance as an overall electrohydrodimerization process improvement and an improved recovery process.

b. Prior art

It is well known to purge electrolytic (aqueous solutions from electrohydrodimerization reaction cells, and to recover the dimerized product, the conductive salt, and/or other recoverable reactants. The extraction of acrylonitrile and quaternary ammonium cations from electrolytic solutions is taught, for example, in Canadian Pat. No. 803,6ll, where the aqueous solution, described as an aqueous mixture, was decanted into an organic phase and a water phase, the former comprising adiponitrile and acrylonitrile, the latter comprising quaternary ammonium salt.

It is also well known to extract acrylonitrile from cathode effluent with adiponitrile, and to use water for the extraction of quaternary ammonium salt from the organic (oil) phase of a two-phase electrolyte system or a quasi biphase elctrolyte system, such as that described in Canadian Pat. No. 803,611 (in which decantation is necessary to separate phases), or from a substantially unphased aqueous solution.

It is also known to crystallize the cathode effluent in order to recover the conductive salt (see U.S. Pat. No. 3,267,131).

The speed at which a commercial dimerization process can be efficiently and economically operated depends in large part upon the efficiency and speed of the recovery subsystem with respect to which prior art procedures, collectively employed, have failed to keep pace with developments related directly to operation of the electrolytic cell.

An efficient coordinated recovery system in which a rate of purge, and replenishment of the electrolyte which permits of substantial reconstitution of the electrolyte with recoverable components at the required rate and with minimum losses of recoverable components, would permit maximum productivity of the electrolytic cell, would constitute a significant advance in the art and is an object of this invention.

SUMMARY OF THE INVENTION

This invention is an improvement in a continuous process for electrohydrodimerization (EHD) of an olefinic compound having the formula $R_2C{=}CR{-}X$ wherein $-X$ is $-CN$, $-CONR_2$ or $-COOR'$, R is hydrogen or R' and R' is $C_1$–$C_4$ alkyl, to form a dimerized product in which an aqueous electrolyte solution, having dissolved therein at least 0.1% by weight of the olefinic compound, at least $10^{-5}$ gram mol per liter of quaternary ammonium cations and at least 0.1% by weight of conductive salt, the aqueous solution being in contact with the cathodic surface having a cathode potential sufficient for hydrodimerization of the olefinic compound, the process including purging the aqueous electrolyte solution and recovering dimerized product by extracting with the olefinic compound the dimerized product from the aqueous solution (or from the purged aqueous solution or the aqueous phase of a two phase aqueous solution) thereby to produce a product extraction which includes the olefinic compound leaving behind the product extraction residue and by extracting with water quaternary ammonium salt (directive salt) from the product extraction (or from the aqueous solution the purged aqueous solution or the organic phase of a two-phase aqueous solution) so as to produce a directive salt extraction and a directive salt extraction residue including the olefinic compound and preferably including the dimerized product and to create a process water gain, crystallizing the product extraction residue to recover the conductive salt and reconstituting the aqueous solution employing the recovered salt and the recovered quaternary ammonium salt, the improvement being evaporating the product residue in an amount not to exceed, and preferably about equal to, the process water gain to a conductive salt concentration of 10–30% before crystallizing, thereby minimizing conductive salt loss in the crystallizing step, making up process water balance by substantially reducing, preferably substantially eliminating, water gained in the process including the water gained in extracting the quaternary ammonium salts, preferably permitting a substantially reconstituted continuous purge recovery of at least about 25 grams of electrolyte solution per faraday, preferably 33 grams per faraday as well as a percentage point rise in selectivity of the dimerized product at the preferred purge rate of at least about 2 over the improved process.

The improved recovery process is also considered an aspect of this invention.

BRIEF DESCRIPTION OF THE DRAWING

To better understand this invention, reference will be made to the attached drawing in which the FIGURE is a schematic process flow diagram showing the process improvement of the instant invention and the improved recovery process.

DEFINITIONS

By "directive salt" is meant the introductory source and the recovered form of the quaternary ammonium cation which is usually, although not necessarily, in the form of a salt.

By "purge" is meant a stream of effluent of the aqueous electrolyte solution or the aqueous phase of a two phase electrolyte solution which is removed from the reaction site or cell for recovery of the dimerized product (in the case of the single phase system only) and recoverable reactants the latter to be employed in reconstituting the aqueous solution, and elimination of non-recoverable reactants.

By "substantially reconstituted purge recovery" is meant a recovery from the purge stream of recoverable reactants (at a rate not substantially less than the rate at which the aqueous electrolyte solution must be substantially reconstituted with the recovered reactants e.g. quaternary ammonium cations and conductive salt) and reconstitution of the electrolyte solution to avoid significant losses arising from a difference in the purge and recovery rates. According to the present state of the recovery art, the term "substantially" as employed in this phrase is meant at least about 80% of the original weight of quaternary ammonium cations and of the conductive salt.

By "aqueous solution" is meant any conductive electrolyte solution or any emulsion in which an aqueous phase is supporting an organic or oil phase, or any phase of the conductive electrolyte solution. The term is also used in the generic sense to include the purged aqueous electrolyte solution and the product extraction.

By "product extraction" is meant any mixture including the dimerized product in substantial quantities and the olefinic compound with which the dimerized product has been extracted from the purged aqueous solution. A product extraction may include a substantial quantity of the aqueous solution.

DETAILED DESCRIPTION OF THE INVENTION

Olefinic compounds that can be hydrodimerized according to this invention include those having the structural formula $R_2C{=}CR{-}X$ wherein —X is —CN, $-CONR_2$ or —COOR′, R is hydrogen or R′ and R′ is $C_1$–$C_4$ alkyl (i.e., methyl, ethyl, n-propyl, isopropyl, n-butyl, isobutyl or tert-butyl). Compounds having that formula are known as having alpha, beta mono-unsaturation and in each such compound, at least one R may be R′ while at least one other R is hydrogen and at least one R′, if present, may be an alkyl group containing a given number of carbon atoms while at least one other R′, if present, is an alkyl group containing a different number of carbon atoms. Such compounds include olefinic nitriles such as, for example, acrylonitrile, methyacrylonitrile, crotononitrile, 2-methylenebutyronitrile, 2-pentenenitrile, 2-methylenevaleronitrile, 2-methylenehexanenitrile, tiglonitrile or 2-ethylidenehexanenitrile; olefinic carboxylates such as, for example, methyl acrylate, ethyl acrylate or ethyl crotonate; and olefinic carboxamides such as, for example, acrylamide, methacrylamide, N,N-diethylacrylamide or N,N-diethylcrotonamide. Products of hydrodimerization of such compounds include those having the structural formula $X{-}CHR{-}CR_2{-}CR_2{-}CHR{-}X$ wherein X and R have the aforesaid significance, i.e., paraffinic dinitriles such as, for example, adiponitrile and 2,5-dimethyladiponitrile; paraffinic dicarboxylates such as, for example, dimethyladipate and diethyl-3,4-dimethyladipate; and paraffinic dicarboxamides such as, for example, adipamide, dimethyladipamide and N,N′-dimethyl-2,5-dimethyladipamide. All of such hydrodimers are useful in the manufacture of high molecular weight condensation polymers, e.g. by reaction with dihydroxy or dicarboxylic compounds, and in the case of the dinitriles, as intermediates which can be hydrogenated by known processes to prepare paraffinic diamines that are similarly useful in the manufacture of high molecular weight condensation polymers. Other examples of the various olefinic compounds that can be hydrodimerized by the process of this invention and the hydrodimers thereby produced are identified in U.S. Pat. Nos. 3,193,481–483.

The invention is herein described in terms of electrolyzing an aqueous solution having dissolved therein certain proportions of the olefinic compound to be hydrodimerized, quaternary ammonium cations and a conductive salt. Such use of the term "aqueous solution" does not imply, however, that the electrolysis medium may not also contain an undissolved organic phase. To the contrary, the process of this invention can be quite satisfactorily carried out by electrolyzing the aqueous solution in an electrolysis medium containing the recited aqueous solution and a dispersed but undissolved organic phase in any proportions at which the aqueous solution is the continuous phase of the electrolysis medium. Hence in some embodiments of the invention, the aqueous solution may be suitably electrolyzed in an electrolysis medium containing essentially no undissolved organic phase, by which is meant either no measurable amount of undissolved organic phase or a minute proportion of undissolved organic phase having no significant effect on the hydrodimer selectivity achieved when the aqueous solution is electrolyzed in accordance with the process of the invention. Such a minute proportion, if present, would be typically less than 5% of the combined weight of the aqueous solution and the undissolved organic phase in the electrolysis medium. In other embodiments, the process of the invention can be carried out by electrolyzing the aqueous solution in an electrolysis medium comprising the recited aqueous solution and a dispersed but undissolved organic phase in a larger proportion (e.g. from about 5% up to about 15%, 20% or even about 25% or more of the combined weight of the aqueous solution and the undissolved organic phase in the electrolysis medium) which may or may not significantly affect the hydrodimer selectivity depending on other conditions of the process. In continuous process embodiments involving recycle of unconverted olefinic compound and whether present in a minute or larger proportion, such an organic phase would be normally made up mainly (most commonly at least about 75%) of the olefinic compound to be hydrodimerized and the hydrodimer product with some small amounts of organic hydrodimerization by-products, quaternary ammonium cations, etc. possibly also present. Typically, such an organic phase contains at least about 10%, preferably between about 15% and about 50%, and even more desirably between about 20% and about 40% of the olefinic compound to be hydrodimerized. In any event, however, the concentrations of the constituents dissolved in the aqueous solution to be electrolyzed, as set forth in this specification and the appended claims, are with reference to the recited aqueous solution alone and not the combined contents of said aqueous solution and an undissolved organic phase which, as aforesaid, may be present but need not be present in the electrolysis medium as the process of this invention is carried out. On the other hand, the weight percentages of undissolved organic phase described in this disclosure are based on the combined weight of the aqueous solution and the undissolved organic phase in the electrolysis medium.

Referring now to the constituents of the aqueous phase, the olefinic compound to be hydrodimerized will be present in at least such a proportion that electrolysis of the solution, as described herein, will result in a substantial amount of the desired hydrodimer being produced. That proportion is generally at least about 0.1% of the aqueous solution, more typically at least about 0.5% of the aqueous solution and, in some embodiments of the invention, preferably at least about 1% of the aqueous solution. Inclusion of one or more additional constituents which increase the solubility of the olefinic compound in the solution may permit the carrying out of the process with the solution containing relatively high proportions of the olefinic compound, e.g. at least about 5% or even 10% or more, but in most embodiments of the invention, the aqueous solution contains less than about 5% (e.g. not more than 4.5%) of the olefinic compound and, in many of those embodiments, preferably not more than about 1.8% of the olefinic compound.

The minimum required proportion of quaternary ammonium cations is very small. In general, there need be only an amount sufficient to provide the desired hydrodimer selectivity (typically at least about 75%) although much higher proportions can be present if desired or convenient. In most cases, the quaternary ammonium cations are present in a concentration of at least about $10^{-5}$ gram mol per liter of the aqueous solution. Even more typically their concentration is at least about $10^{-4}$ gram mol per liter of the solution and, in many embodiments, preferably at least about $10^{-3}$ gram mol per liter. Although higher proportions may be present in some cases, as aforesaid, the quaternary ammonium cations are generally present in the aqueous solution in a concentration lower than about 0.5 gram mol per liter and even more usually, in a concentration not higher than about $10^{31\ 1}$ gram mol per liter. In some preferred embodiments, the concentration of quaternary ammonium cations in the solution is at least about $2\times10^{-3}$ gram mol per liter but not more than about $5\times10^{-2}$ and, in many cases, not more than about $2\times10^{-2}$ gram mol per liter.

The quaternary ammonium cations that are present in such concentrations are those positively-charged ions in which a nitrogen atom has a valence of five and is directly linked to other atoms (e.g. carbon) satisfying four fifths of that valence. Such cations may be cyclic, as in the case of the piperidiniums, pyrrolidiniums and morpholiniums, but they are generally of the type in which the nitrogen atom is directly linked to a total of four monovalent organic groups from the group consisting of alkyl and aryl radicals and combinations thereof. The aryl groups contain typically from six to twelve carbon atoms and preferably only one aromatic ring as in, for example, a phenyl or benzyl radical. The alkyl groups can be straight-chain, branched or cyclic and each typically contains from one to twelve carbon atoms. Although quaternary ammonium cations containing a combination of such alkyl and aryl groups (e.g. benzyltriethylammonium ions) can be used, many embodiments of the invention are preferably carried out with tetraalkylammonium ions and superior results are generally obtained with the use of those containing at least three $C_2$–$C_6$ alkyl groups and a total of from 8 to 24 carbon atoms in the four alkyl groups, e.g. tetraethyl-, ethyltripropyl-, ethyltributyl-, ethyltriamyl-, ethyltrihexyl, octytriethyl-, tetrapropyl-, methyltripropyl-, decyltripropyl, methyltributyl-, tetrabutyl-, amyltributyl-, tetraamyl-, tetrahexyl-, ethyltrihexyl-, diethyldioctylammonium and many others referred to in the aforecited U.S. Pat. Nos. 3,193,481–483. Most practical from the economic standpoint are generally those tetraalkylammonium ions in which each alkyl group contains two to five carbon atoms, e.g. diethyldiamyl-, tetrapropyl-, tetrabutyl-, amyltripropyl-, tetraamylammonium, etc. Such cations can be incorporated into the aqueous solution to be electrolyzed by dissolving a "directive salt", preferably a quaternary ammonium salt but alternatively a hydroxide in the solution in the amount required to provide the desired quaternary ammonium cation concentration.

The conductive salt can be a quaternary ammonium salt such as for example a tetraalkylammonium (e.g. tetraethylammonium) sulfate, alkylsulfate (e.g. ethylsulfate) or arylsulfonate (e.g. toluene sulfonate). Although organic salts of that general type can be employed as the conductive salt in a divided or single-compartment cell, it is generally preferred to use an alkali metal conductive salt, i.e., a salt of sodium, potassium, lithium, cesium or rubidium, in single-compartment EHD cells. When such a salt is used, those of lithium and especially sodium and potassium are generally preferred for economic reasons.

Also preferred for such use are the salts of inorganic and/or polyvalent acids, e.g. a tetraalkylammonium or alkali metal orthophosphate, borate, perchlorate, carbonate or sulfate, and particularly an incompletely-substituted salt of that type, i.e., a salt in which the anion has at least one valence thereof satisfied by hydrogen and at least one other valence thereof satisfied by an alkali metal. Examples of such salts include disodium phosphate ($Na_2HPO_4$), potassium acid phosphate ($KH_2PO_4$), sodium bicarbonate ($NaHCO_3$) and dipotassium borate ($K_2HBO_3$). Also useful are the alkali metal salts of condensed acids such as pyrophosphoric, metaphosphoric, metaboric, pyroboric and the like (e.g. sodium pyrophosphate, potassium metaborate, borax, etc.) and/or the products of partial or complete hydrolysis of such condensed acid salts. Depending on the acidity of the aqueous solution to be electrolyzed, the stoichiometric proportions of such anions and alkali metal cations in the solution may correspond to a mixture of two or more of such salts, e.g. a mixture of sodium acid phosphate and disodium phosphate, and accordingly, such mixtures of salts (as well as mixtures of salts of different cations, e.g. different alkali metals, and/or different acids) are intended to be within the scope of the expressions "conductive salt" and "alkali metal phosphate, borate, perchlorate, carbonate or sulfate" as used in this specification and the appended claims. Any of the alkali metal salts may be dissolved in the aqueous solution as such or otherwise, e.g. as the alkali metal hydroxide and the acid necessary to neutralize the hydroxide to the extent of the desired acidity of the aqueous solution.

The concentration of conductive salt in the solution should be at least sufficient to substantially increase the electrical conductivity of the solution above its conductivity without such a salt being present. In most cases, a concentration of at least about 0.1% is favored. More advantageous conductivity levels are achieved when the solution has dissolved therein at least about 1% of the conductive salt or, even more preferably, at least about 2% of such a salt. In many cases, optimum process conditions include the solution having dissolved therein more than 5% (typically at least 5.5%) of the conductive salt. When an alkali metal conductive salt is used, the maximum amount of salt in the solution is typically limited only by its solubility therein, which varies with the particular salt employed. With salts such as sodium or potassium phosphates, it is generally most convenient when the solution contains between about 8% and about 13% of such a salt or mixture thereof.

Generation of molecular hydrogen at the cathode of a process of the type discussed herein can be substantially inhibited by including in the aqueous electrolysis medium at least one nitrilocarboxylic acid compound such as, for example, a nitriloacetic or nitrilopropionic acid compound having the formula $Y_2N\text{-}(Z\text{—}YN)_n\text{-}(CH_2)_mCOOM$ wherein Y is a monovalent radical such as hydrogen, $\text{-}(CH_2)_mCOOM$, $\text{-}(CH_2)_{m+1}OH$ or $C_1$–$C_{20}$ alkyl (e.g. ethyl, n-propyl, tert-butyl, n-hexyl, n-decyl, etc.); Z is a divalent $C_2$–$C_6$ hydrocarbon (e.g. alkylene) radical such as, for example, n-hexylene, n-butylene, iso-butylene or, generally more desirably, ethylene or n-propylene; M is a monovalent radical such as hydrogen, an alkali metal (e.g. lithium or, usually most desirably, sodium or potassium) or ammonium; m is 1 or 2; n represents the number of repeating $\text{-}(Z\text{—}YN)\text{-}$ groups, if any, and may be 0, 1, 2, 3 or 4; and at least one Y is said formula is $\text{-}(CH_2)_m\text{-}COOM$ or $\text{-}(CH_2)_{m+1}OH$, i.e., the nitrilocarboxylic acid compound contains at least one $\text{-}(CH_2)_mCOOM$ or $\text{-}(CH_2)_{m+1}OH$ group in addition to the $\text{-}(CH_2)_m\text{-}COOM$ group on the right-hand end of the generic nitrilocarboxylic acid compound formula as shown hereinbefore. At least one such additional $\text{-}(CH_2)_m\text{-}COOM$ or $\text{-}(CH_2)_{m+1}OH$ group is usually desirably attached to the nitrogen atom on the left-hand end of that generic formula but when n is 1, such an additional group may be attached (alternatively or otherwise) to the nitrogen atom in the $\text{-}(Z\text{—}YN)\text{-}$ unit, and when n is 2, 3 or 4, any one or more of the nitrogen atoms in the repeating $\text{-}(Z\text{—}YN)\text{-}$ units may have such an additional $\text{-}(CH_2)_mCOOM$ or $\text{-}(CH_2)_{m+1}OH$ group attached thereto.

Preferably, but not necessarily, there are at least two $\text{-}(CH_2)_mCOOM$ groups in the nitrilocarboxylic acid compound employed. It is also generally desirable for each Y in the compound to be $\text{-}(CH_2)_mCOOM$ or $\text{-}(CH_2)_{m+1}OH$, for Z to be $C_2$–$C_4$ alkylene and for n to be 0, 1, 2 or 3 (even more desirably 0, 1 or 2 and most preferably 1 or 2). Representative of such compounds are nitrilotriacetic acid, N-hydroxyethylethylenediaminetriacetic acid, diethylenetriaminepentaacetic acid, N,N-di(2-hydroxyethyl)glycine, ethylenediaminetetrapropionic acid and, typically most favored, ethylenediaminetetraacetic acid (hereinafter sometimes represented as EDTA). In the low concentrations generally employed, they may be added to the electrolysis medium of the present process as acids or, usually more conveniently, as partially or fully neutralized salts thereof (e.g. the ammonium or alkali metal salts of such acids). In accordance with procedures known in the art, alkali metal salts of such nitrilocarboxylic acid compounds can be prepared by reacting the appropriate amine (e.g. ethylenediamine) with an alkali metal salt of chloracetic acid in the presence of an alkali metal hydroxide, or with hydrogen cyanide and formaldehyde and then an alkali metal hydroxide, or with ethylene glycol to provide hydroxyethyl substituents on the nitrogen atom(s) of the amine and then reacting the hydroxyethyl-substituted amine with an alkali metal hydroxide in the presence of cadmium oxide to convert the hydroxyethyl substituents to alkali metal acetate substituents in the proportion desired, or with acrylonitrile in the presence of a base (e.g. sodium hydroxide) and then hydrolyzing the cyanoethylated amine in the presence of an alkali metal hydroxide.

In general, at least about 0.025 millimol of the nitrilocarboxylic acid compound per liter of the solution is desirable and at least about 0.1 millimol per liter is preferred. In most cases having greater attraction for commercial use, at least about 0.5 millimol per liter is more desirable and at least about 2.5 millimols per liter usually provide even better results. Generally, not more than about 50 millimols per liter are required, although higher concentrations may be employed if desired. Even more typically, economic results are better when the concentration of the nitrilocarboxylic acid compounds in the solution is not greater than 25 millimols per liter. With reference to such concentrations, it should be understood that the nitrilocarboxylic acid compounds used herein may degrade under the conditions of the process, e.g. to compounds that have lower molecular weight and/or fewer $\text{-}(CH_2)_mCOOM$ or $\text{-}(CH_2)_{m+1}OH$ groups but which nevertheless provide the advantages of this invention in substantial measure, and accordingly such degradation products should be considered as equivalent to the undegraded nitrilocarboxylic acid compounds to the extent that they provide the advantages thereof, when measuring or otherwise identifying a nitrilocarboxylic acid compound concentration with reference to the process of this invention. Mixtures of two or more of the aforedescribed nitrilocarboxylic acid compounds may also be used in the process of this invention and accordingly, such mixtures are meant to be within the scope of the expression "a nitrilocarboxylic acid compound" as used in this disclosure and the appended claims.

When carrying out the present process in conjunction with a cell divided by a cation-permeable membrane and particularly when carrying out the process in a single-compartment cell, generation of hydrogen at the cathode is even more significantly inhibited by including in the electrolysis medium a boric acid, a condensed phosphoric acid or an alkali metal or ammonium salt thereof. The boric acid or borate may be added to the solution as orthoboric acid, metaboric acid or pyroboric acid and then neutralized to the desired solution pH, e.g. with an alkali metal (preferably the cation of the conductive salt) or ammonium hydroxide or as a completely or incompletely substituted alkali metal or ammonium salt of such an acid (e.g. disodium or monosodium orthoborate, potassium metaborate, sodium tetraborate or the hydrated form thereof commonly called borax). The condensed phosphoric acid or phosphate may be added as a polyphosphoric (e.g. pyrophosphoric or triphosphoric) acid and then neutralized to the desired solution pH or as a completely or incompletely substituted alkali metal or ammonium salt thereof (e.g. tetrasodium pyrophosphate, potassium hexametaphosphate or ammonium triphosphate).

In general, the condensed phosphoric acids and their alkali metal or ammonium salts tend to hydrolyze in the electrolysis medium at rates dependent on their concentration, the solution pH, etc. It is believed, however, that the products of such hydrolysis continue to inhibit the generation of hydrogen at the cathode as long as they remain condensed to at least some degree, i.e., so long as they have not been hydrolyzed to the orthophosphate form, and hence the preferred concentrations of such condensed phosphoric acid compounds are herein expressed in terms of weight percent of a condensed phosphoric acid (which may be the one originally added to the solution or hydrolysis products thereof having a lower but conventionally recognizable degree of molecular condensation) or the molar equivalent of an alkali metal or ammonium salt thereof. When such a condensed phosphoric acid is used in the process of this invention, and particularly in a single-compartment cell having a metallic anode (e.g. an anode comprising a ferrous metal such as carbon steel, alloy steel, iron or magnetite), it is generally advantageous for the solution to contain at least about 0.01%, preferably between about 0.02% and about 3%, and often most desirably between about 0.02% and about 2% of the condensed phosphoric acid or the molar equivalent (molecularly equivalent amount) of an alkali metal or ammonium salt thereof.

The aforementioned boric acids and alkali metal or ammonium salts thereof, on the other hand, tend to relatively rapidly form in the electrolysis medium a variety of boron-containing ions having relative proportions normally dependent on their concentrations, the solution pH, etc., and generally including both uncondensed (i.e., orthoborate) and condensed (e.g. metaborate, tetraborate, polymeric, ring-containing, etc.) ions, regardless of whether the acids and/or salts originally added to the electrolysis medium were in condensed or uncondensed form at that time. In other words, condensed borates (e.g. tetraborates) normally convert in the eletrolysis medium in part to orthoborate ions and in part to other condensed borate ions, while orthoborates added as such generally form various condensed borate ions, depending largely on the solution pH, etc. In any event, it appears that the boron-containing ions are effective for purposes described whether they are present in condensed or uncondensed forms or a mixture thereof and accordingly, preferred concentrations of the boric acids or salts are herein expressed (on the basis of one liter of solution) in terms of gram atoms of boron which may be present in the ionic form of condensed or uncondensed borates or other boron-containing moieties provided by interaction between the electrolysis medium and the boric acids and/or salts added thereto. When such boric acids or salts are used in a single-compartment cell having a metallic anode (e.g. an anode comprising a ferrous metal such as carbon steel, alloy steel, iron or magnetite), it is generally desirable for the boron concentration in the electrolysis medium to be at least about 0.01 and preferably 0.02 gram atom of boron per liter of solution. It is generally not necessary that the boron concentration in the solution be greater than about 0.9 gram atom per liter and in many cases it need not be greater than about 0.5 gram atom per liter, although higher concentrations are not necessarily detrimental and may be advantageous, e.g. if it is intended that a boric acid salt provide a substantial portion of the electrical conductivity of the electrolysis medium.

In most cases, the pH of the bulk of the electrolysis medium is greater than two, preferably at least about five, more preferably at least about six and most conveniently at least about seven, especially when the process is carried out in a single-compartment cell having a metallic anode. On the other hand, the overall solution pH is generally not higher than about twelve, typically not higher than about eleven and, with the use of sodium and/or potassium phosphates, generally not substantially higher than about ten.

The temperature of the solution may be at any level compatible with existence as such of the solution itself, i.e., above its freezing point but below its boiling point under the pressure employed. Good results can be achieved between about 5° and about 75° C. or at even high temperatures if pressures substantially above one atmosphere are employed. The optimum temperature range will vary with the specific olefinic compound and hydrodimer, among other factors, but in hydrodimerization of acrylonitrile to adiponitrile, electrolysis temperatures of at least about 25° are usually preferred and those between about 40° and about 65° C. are especially desirable.

Electrolytic hydrodimerization of an olefinic compound having a formula as set forth hereinbefore must be carried out in contact with a cathodic surface having a cathode potential sufficient for hydrodimerization of that compound. In general, there is no minimum current density with which the present process can be carried out at such a cathodic surface but in most cases, a current density of at least about 0.01 amp per square centimeter of the cathodic surface is used and a current density of at least about 0.05 amp per square centimeter of the cathodic surface is usually preferred. Although higher current densities may be practical in some instances, those generally employed in the present process are not higher than about 1.5 amps per square centimeter and even more typically not higher than about 0.75 amp per square centimeter of the aforedescribed cathodic surface. Depending on other process variables, current densities not higher than about 0.5 amp per square centimeter may be preferred in some embodiments of the process.

Although not necessary, a liquid-impermeable cathode is usually preferred. With the use of such a cathode, the aqueous solution to be electrolyzed is generally passed between the anode and cathode at a linear velocity with reference to the adjacent cathodic surface of at least about one foot per second, preferably at least about two feet per second and even more preferably between about three and about eight feet per second although a solution velocity up to twenty feet per second or higher can be employed, if desired. The gap between the anode and cathode can be very narrow, e.g. about 40 mils or less, or as wide as one-half inch or even wider, but is usually most conveniently of a width between about 60 mils and about one-quarter inch. In the process of this invention, the cathodic surface can be made of virtually any material at which the requisite cathode potential can be provided and which is not dissolved or corroded at an intolerable rate. In general, the process can be carried out with a cathode comprising cadmium, mercury, thallium, lead, zinc, manganese, tin or graphite, by which is meant that the cathodic surface contains a high percentage (generally at least about 95% and preferably at least about 98%) of one or a combination (e.g. an alloy) of two or more of such materials, but it may contain a small amount of one or more other constituents that do not alter the nature of the cathodic surface so as to prevent substantial realization of the advantages of the present invention, particularly as described herein. Such other constituents, if present, are desirably other materials having relatively high hydrogen overvoltages but preferably not such materials of relatively low hydrogen overvoltage as copper or nickel in a concentration substantially higher than about 0.05% or, even more desirably, about 0.02%, based on the total composition of the material of which the cathodic surface is composed. Of particular preference are cathodes comprising cadmium, lead, zinc, manganese, tin, graphite, or an alloy of one of such metals, and especially cathodes comprising cadmium. Best results are usually obtained with a cathodic surface having a cadmium content of at least about 99.5%, even more typically at least about 99.8% and most desirably at least about 99.9% as in ASTM Designation B440-66T (issued 1966).

Cathodes employed in this invention can be prepared by various techniques such as, for example, electroplating of the desired cathode material on a suitable-shaped substrate of some other material, e.g. a metal having greater structural rigidity, or by chemically, thermally and/or mechanically bonding a layer of the cathode material to a similar substrate. Alternatively, a plate, sheet, rod or any other suitable configuration consisting essentially of the desired cathode material may be used without such a substrate, if convenient.

The process of this invention can be satisfactorily carried out using a divided cell having a cation-permeable membrane, diaphragm or the like separating the anode and cathode compartments of the cell in such a way that the aqueous solution containing the olefinic compound to be hydrodimerized is not in contact with the anode of the cell. However, it is especially advantageously carried out in a cell that is not divided in that manner, i.e., in a cell in which the anode or anodes and the cathode or cathodes are in direct physical contact with the solution being electrolyzed. In this mode, and especially in the absence of a boric or condensed phosphoric acid or salt thereof in the preferred concentrations descrbed hereinbefore, it has been found that the aforementioned nitrilocarboxylic acid compounds, and especially in the concentrations cited hereinbefore, generally substantially inhibit the corrosion of metallic anodes when used in such undivided cells. Anodes whose corrosion may be thereby inhibited include those composed of, for example, platinum, ruthenium, nickel, lead, lead dioxide and, of particular advantage when the conductive salt is a phosphate, borate or carbonate, ferrous materials such as carbon steels, alloy steels, iron and magnetite.

An especially preferred version of electrohydrodimerization is carried out with a single-compartment cell having an anode comprising a ferrous metal and with the use of an alkali metal phosphate, borate or carbonate conductive salt and an electrolysis medium having a pH not substantially below seven. Of great interest from the economic standpoint are those embodiments employing an anode consisting essentially of carbon steel, exemplary compositions of which are listed in the 1000, 1100 and 1200 series of American Iron and Steel Institute and Society of Automotive Engineers standard steel composition numbers, many of which may be found on page 62 of Volume 1, Metals Handbook, 8th Edition (1961) published by the American Society for Metals, Metals Park, Ohio, U.S.A.

In general, the carbon steels that are advantageously used as anode materials in the process of this invention contain between about 0.02% carbon (more typically at least about 0.05% carbon) and about 2% carbon. Normally, carbon steels such as those of the AISI and SAE 1000 series of standard steel composition numbers are preferred and those containing between about 0.1% and about 1.5% carbon are typically most desirable. Regardless of the material from which it is made, each anode in the cell may be in the form of a plate, sheet, strip, rod or any other configuration suitable for the use intended. In a preferred embodiment, however, the anode is in the form of a sheet (e.g. of cold-rolled carbon steel) essentially parallel to and closely spaced from a cathode surface of approximately the same dimensions.

As indicated above, a portion of a single phase aqueous solution may be subjected to extraction in order to isolate the dimerized product and to recover the quaternary ammonium salt. If the aqueous solution is separable in phases, a portion of the lower (aqueous) phase may be subjected to extraction for the dimerized product, and the upper (organic) phase for the quaternary ammonium cation.

If the purge is of a single-phase aqueous solution, there may be two extractions in series, the first being extraction from the purged aqueous solution of the dimerized product with the olefinic compound from which is produced a product extraction comprising the olefinic compound and the dimerized product, leaving behind a product extraction residue containing the conductive salt. The quaternary ammonium cations are then removed from the product extraction by further extracting with water to produce a quaternary ammonium extraction which includes the directive quaternary ammonium salt and a quaternary ammonium extraction residue comprising the olefinic compound and the dimerized product. The quaternary ammonium extraction residue is then distilled to remove the dimerized product leaving behind the olefinic compound.

If on the other hand, and as illustrated in the Figure, the aqueous solution is in a double phase, the dimerized product may be recovered by extracting from the lower or aqueous phase of the aqueous solution with the olefinic compound to recover the dimerized product, leaving a product extraction residue for evaporation, crystallization and recovery of the conductive salt. In this case, the dimerized product and the olefinic compound may be returned to the aqueous solution and thereafter withdrawn as the organic phase or upper layer, which is then subjected to extraction with water to remove quaternary ammonium salt which is thereafter recovered. The quaternary ammonium extraction residue may then be subjected to distillation for the removal of the dimerized product.

Removal of the electrolyte and reaction components from the electrolysis cell may be by pumping, gravity flow or other suitable means. It is desirable, of course, that the olefinic compound employed as extractant be one which is being reductively coupled in the electrolysis. The extraction can be conducted by ordinary mixing and decantation, counter-current extraction procedures, or other means known to the art. If desired, procedures and apparatus of the type illustrated in U.S. Pat. No. 3,193,477 (hereby incorporated by reference) may be employed for simultaneously forming, extracting and isolating the dimerized product or for effecting the extraction and isolation of the product separately from the electrolysis reaction.

Evaporation is by any suitable means known in the art. As stated above, evaporation of the electrolyte purge (aqueous solution) is a means, not only of maintaining process water balance, to offset water added during recovery of the quaternary ammonium cation, but also to concentrate the aqueous solution so as substantially to reduce losses of electrolyte materials in the final mother liquor. It has been found, for example, that a certain percentage (6.2% in the case of sodium phosphate) conductive salt remains in the mother liquor after crystallization. Accordingly, the content of water at the onset of crystallization should be minimally consistent with the proper formation of crystals. In the case of sodium phosphate as a conductive salt, it has been found that a conductive salt concentration in excess of 30% will result in a paste rather than crystals. Accordingly, the range of conductive salt concentration should be about 10–30%. Such concentration limits will vary from with the particular conductive salt, but the principle remains the same. A preferred evaporation of the product extraction residue is conducted at about atmospheric pressure, and a temperature of about 103°–107° C. A lower than atmospheric pressure operation may be employed in accordance with this invention. Crystallization is preferably conducted at a temperature of 15°–20° C. and a pressure of 13–18 mm mercury with a feed temperature and pH respectively of 35°–45° C. and 9.2–9.5. Crystallization time of about 1 hour is desirable.

The fully reconstituted purge of at least 25 grams per Faraday (preferably at least about 33 grams per faraday), along with the minimization of conductive salt loss in the crystallizing step is made possible by evaporation of the product extraction residue prior to crystallization. At the preferred purge rate of about 33 grams per faraday, a percentage point rise in selectivity of the dimerized product of at least about 2 has been demonstrated over the unimproved process.

Referring now in detail to the drawing, the Figure is a block flow diagram showing schematically a typical recovery system for a typical hydrodimerization process of acrylonitrile to adiponitrile. The aqueous solution is contained in EHD cell 1, from which, at a preferred rate of at least 33 grams per faraday, electrolyte 2 (lower layer of the aqueous solution) is withdrawn and transferred to ADN (adiponitrile) extraction 3 where the lower layer (aqueous phase of the emulsion is extracted with acrylonitrile, the product extraction 19 being returned to EHD cell 1, and the product extraction residue 4 being transferred to evaporator 5 wherein the concentration of the conductive salt (sodium phosphate) is increased to about 20% by evaporation at atmospheric pressure at a temperature of about 105° C. The evaporated product extraction residue (evaporated) 6 is then transferred to crystallization - filtration 7 where it is cooled to a temperature of about 18° C. whereupon sodium phosphate is recovered in crystalline form as recovered conductive salt 17 by filtration and wash (see wash 23) and transferred to electrolyte make-up 11. The purged mother liquor 8 from crystallization filtration 7 then undergoes cadmium removal 9 wherein traces of the cathode (cadmium) are extracted, leaving the cadmium-free mother liquor 10 for disposal to waste treatment. The upper layer of the aqueous solution or electrolyte 12 is removed from EHD cell 1 and transported to QA (quaternary ammonium) extraction 13 from which, after extraction with process water 15, directive salt extraction 18, containing the quaternary ammonium salt, is transferred to elecrolyte make-up 11. Directive salt extraction residue 14, containing acrylonitrile is removed for subsequent distillation and recovery of the pure acrylonitrile. The amount of evaporation in evaporator 5 is adjusted generally to correspond with the amount of process water 15 added to QA extraction 13. Wherever other process water is added to the recovery system, an additional adjustment may be required.

In addition to recovered conductive salt 17 and directive salt extraction 18, phosphoric acid, sodium hydroxide and boric acid are added as feed lines 20, 21, and 22 respectively to electrolyte make-up 11.

We claim:

1. In a continuous process for hydrodimerization of an olefinic compound having the formula $R_2C{=}CR{-}X$ wherein $-X$ is $-CN$, $-CONR_2$ or $-COOR'$, R is hydrogen or R' and R' is $C_1$–$C_4$ alkyl, to form a dimerized product, which comprises electrolyzing in a reaction cell an aqueous electrolyte solution having dissolved therein at least 0.1% by weight of the olefinic compound, at least $10^{-5}$ gram mol per liter of quaternary ammonium cations of a directive salt and at least 0.1% by weight of conductive salt, the aqueous solution having an organic phase and an aqueous phase, being in contact with the cathodic surface having a cathode potential sufficient for hydrodimerization of the olefinic compound, purging the aqueous solution, recovering dimerized product by extracting with the olefinic compound the dimerized product from the aqueous phase of the purged aqueous solution thereby producing a product extraction comprising the dimerized product and the olefinic compound and leaving a product extraction residue comprising conductive salt; extracting with water quaternary ammonium salt from the organic phase of the aqueous solution thereby producing a directive salt extraction comprising quaternary ammonium salt and water and a directive salt extraction residue comprising the dimerized product, and thereafter crystallizing the product extraction residue to recover the conductive salt, and reconstituting the aqueous solution employing the recovered conductive salt and the recovered quaternary ammonium salt, the improvement comprising evaporating the product extraction residue, in an amount not to exceed process water gain, to a conductive salt concentration of 10–30% before crystallizing, thereby minimizing conductive salt loss in the crystallizing step, making up process water balance by substantially reducing water gained in the process including water gained in extracting the quaternary ammonium salt.

2. The process improvement of claim 1 further including a substantially reconstituted continuous purge recovery of at least about 25 grams of elecrolyte per faraday.

3. The process improvement of claim 2 wherein the purge recovery is at least about 33 grams of electrolyte per faraday.

4. The method of claim 1 wherein the product extraction residue is evaporated in an amount substantially equivalent to process water gain and process water balance is thereby made up by substantially eliminating water gained in the process including water gained in extracting quaternary ammonium salt, the improvement being also characterized by a fully reconstituted purge of at least about 33 grams of electrolyte per faraday.

5. The process improvement of claim 1 in which the aqueous solution includes, in a concentration sufficient to inhibit formation of hydrogen at the cathodic surface, a nitrilocarboxylic acid compound having the formula $Y_2N{-}(Z{-}YN)_n{-}(CH_2)_m COOM$ wherein Y is hydrogen, $(CH_2)_m COOM$, $(CH_2)_{m+1}OH$ or $C_1$–$C_{20}$ alkyl, Z is a divalent $C_2$–$C_6$ hydrocarbon radical, M is hydrogen, alkali metal or ammonium, M is 1 or 2, n is 0 or an integer from 1 to 4 and at least one Y is $(CH_2)COOM$ or $(CH_2)_{m+1}OH$.

6. The process improvement of claim 5, wherein the nitrilocarboxylic acid compound is a compound selected from the group consisting of ethylenediaminetetraacetic acid, N-hydroxyethylethylenediaminetriacetic acid, diethylenetriaminepentaacetic acid, nitrilotriacetic acid, N,N-di(2-hydroxyethyl)glycine or an alkali metal or ammonium salt of such an acid, and the concentration of the nitrilocarboxylic acid compound is between about 0.025 and about 50 millimols per liter.

7. The process of claim 5, in which the nitrilocarboxylic acid compound is selected from the group consisting of ethylenediaminetetrapropionic acid and an alkali metal or ammonium salt of ethylenediaminetetrapropionic acid, and the concentration of the nitrilocarboxylic acid compound is between 0.025 and 50 millimols per liter.

8. The process improvement of claim 1, wherein the olefinic compound is acrylonitrile, the dimerized product is adiponitrile, the cathodic surface comprises a material selected from the group consisting of cadmium, lead, zinc, manganese, tin and graphite, and the aqueous solution has dissolved therein at least 0.5% by weight of the acrylonitrile, at least $10^{-4}$ gram mol per liter of $C_8$–$C_{24}$ tetraalkylammonium ions containing at least three $C_2$–$C_6$ alkyl groups and at least about 1% by weight of a salt selected from the group consisting of alkali metal phosphate, borate, perchlorate, carbonate, and sulfate.

9. The process improvement of claim 1, wherein the reaction cell is a single-compartment cell having a metallic anode in contact with the aqueous solution.

10. The process of claim 1, wherein the aqueous solution further contains a boron derivative selected from the group consisting of boric acid, an alkali metal salt of boric acid, and an ammonium salt of boric acid, in a concentration corresponding to at least about 0.01 gram atoms of boron per liter of solution, and further recovered from the extraction residue is borate, in the amount of at least about 80% of the boron derivative.

11. The process of claim 1, wherein the aqueous solution contains a phosphoric acid derivative selected from the group consisting of phosphoric acid, the alkali metal salt of phosphoric acid, and the ammonium salt of phosphoric acid in an amount equivalent to at least 0.01% by weight of condensed phosphoric acid.

12. A method for selective separation and recovery of adiponitrile, quaternary ammonium cations and conductive salt contained in the effluent from electrohydrodimerization of acrylonitrile to adiponitrile comprising the steps of extracting the effluent thereby to recover electrohydrodimerization reaction products comprising adiponitrile and the quaternary ammonium cations, leaving behind an extraction residue; evaporating the extraction residue to a conductive salt concentration of about 10 to 30%; crystallizing the extraction residue thereby to recover conductive salt.

13. The method of claim 12 wherein the extraction comprises contacting the aqueous solution with acrylonitrile in excess of its solubility in the effluent thereby extracting adiponitrile in a liquid phase.

14. The method of claim 12 wherein extraction comprises diluting the effluent with acrylonitrile and water to provide an acrylonitrile phase and an aqueous phase while extracting the acrylonitrile phase in countercurrent multistage fashion with the water and extracting the aqueous phase in countercurrent multistage fashion with the acrylonitrile to produce an aqueous extract phase containing quaternary ammonium salt substantially free of the reaction products and to produce an acrylonitrile extract phase substantially containing the reaction products and substantially free of quaternary ammonium salt.

15. The method of claim 12 wherein a boron derivative selected from the group consisting of boric acid, an alkali metal salt of boric acid, an ammonium salt of boric acid is also included in the effluent, and further recovered from the extraction residue is borate, in the amount of at least 80% of the boron derivative.

* * * * *